US010072679B2

(12) United States Patent
Hamkins et al.

(10) Patent No.: US 10,072,679 B2
(45) Date of Patent: Sep. 11, 2018

(54) SYSTEMS AND METHODS FOR SELECTIVELY ENGAGED REGENERATION OF A HYDRAULIC SYSTEM

(71) Applicant: HUSCO INTERNATIONAL, INC., Waukesha, WI (US)

(72) Inventors: Eric P Hamkins, Waukesha, WI (US); Jacob Ballweg, Waukesha, WI (US); Joseph Pfaff, Wauwatosa, WI (US); Mark Elton, Waukesha, WI (US)

(73) Assignee: HUSCO International, Inc., Waukesha, WI (US)

( * ) Notice: Subject to any disclaimer, the term of this patent is extended or adjusted under 35 U.S.C. 154(b) by 266 days.

(21) Appl. No.: 14/961,393

(22) Filed: Dec. 7, 2015

(65) Prior Publication Data

US 2016/0160884 A1 Jun. 9, 2016

Related U.S. Application Data

(60) Provisional application No. 62/089,001, filed on Dec. 8, 2014.

(51) Int. Cl.
*F15B 11/024* (2006.01)
*E02F 9/22* (2006.01)

(52) U.S. Cl.
CPC ..... *F15B 11/024* (2013.01); *E02F 9/2217* (2013.01); *E02F 9/2282* (2013.01); *F15B 2211/3059* (2013.01); *F15B 2211/3133* (2013.01); *F15B 2211/329* (2013.01); *F15B 2211/355* (2013.01); *F15B 2211/665* (2013.01); *F15B 2211/6658* (2013.01); *F15B 2211/7053* (2013.01); *F15B 2211/71* (2013.01); *F15B 2211/761* (2013.01)

(58) Field of Classification Search
CPC ..... F15B 11/024; F15B 2211/3059; F15B 2211/3133; F15B 2211/88; E02F 9/2217
USPC ..... 60/473, 468, 436, 437
See application file for complete search history.

(56) References Cited

U.S. PATENT DOCUMENTS

| | | | | |
|---|---|---|---|---|
| 5,907,991 | A * | 6/1999 | Ramamoorthy ..... | E02F 9/2203 91/436 |
| 6,880,332 | B2 | 4/2005 | Pfaff et al. | |
| 7,380,398 | B2 | 6/2008 | Pfaff | |
| 2015/0197915 | A1 | 7/2015 | Zhang et al. | |

* cited by examiner

*Primary Examiner* — F. Daniel Lopez
*Assistant Examiner* — Daniel Collins
(74) *Attorney, Agent, or Firm* — Quarles & Brady LLP

(57) ABSTRACT

A hydraulic system and method for using the same are provided. The hydraulic system includes a pump, a first actuator having a first head chamber and a first rod chamber, and a second actuator having a second head chamber and a second rod chamber. The hydraulic system further includes a first control valve and a second control valve. The second control valve to selectively provide regeneration fluid flow from the first rod chamber to the first head chamber in response to a first function command is less than a first function command limit, a second function command is greater than a second function command limit, and a second function load is greater than a second function load limit.

27 Claims, 6 Drawing Sheets

SYSTEMS AND METHODS FOR SELECTIVELY ENGAGED REGENERATION OF A HYDRAULIC SYSTEM

CROSS-REFERENCES TO RELATED APPLICATIONS

This application is based on, claims priority to, and incorporates herein by reference in its entirety, U.S. Provisional Patent Application No. 62/089,001, filed Dec. 8, 2014, and entitled "System and Method for Selectively Engaged Regeneration of a Hydraulic System."

STATEMENT REGARDING FEDERALLY SPONSORED RESEARCH

Not Applicable.

BACKGROUND

The present invention relates generally to a hydraulic system and, more specifically, to a control valve assembly of a hydraulic system that selectively engages regeneration.

It is typical on digging machines such as backhoes and excavators to transfer earth into the bucket during the 'dig' segment of the cycle. During this cycle the operator will command the arm (aka dipper, crowd) cylinder to extend (arm in), bucket cylinder to extend (bucket curl) and boom cylinder to extend (boom up). During this action all three of the cylinders will extend and fill the bucket under the operators command. The pressures in the cylinders are typically not the same and the pressure difference between the pump and the cylinders is throttled by either a primary spool valve that the operator is commanding or a pressure compensator. These throttling losses create hydraulic heat and have a negative effect on machine efficiency. It is typical on these machines to have power efficiencies from pump outlet to the cylinders in the mid-60% range during the digging operation segments. One of the key sources of hydraulic heat and inefficiency is the gap between the high pressure load in the arm during digging which sets the pump pressure and the relatively low pressure load in the boom. If the operator is not commanding boom during the cycle there are no losses to the boom. In some duty cycles, almost half of the total losses during the dig are from the unequal pressure between the boom and pump caused by the high arm load. Due to the other dig segments and varied use of the machine, the boom cylinders cannot be redesigned to mitigate this pressure difference.

Accordingly, there remains a considerable need for hydraulic control valve systems that can improve the efficiency of the operation to overcome these shortcomings.

SUMMARY OF THE INVENTION

In one aspect, the present invention provides a control valve assembly for a hydraulic system. The hydraulic system includes a first function operated by a first actuator, a second function operated by a second actuator, and a pump to furnish fluid from a reservoir to a supply conduit. The first actuator includes a first head chamber and a first rod chamber, and the second actuator includes a second head chamber and a second rod chamber. The control valve assembly includes a first control valve to selectively provide fluid communication between the first actuator and both the supply conduit and the reservoir in response to a first function command, a second control valve to selectively provide fluid communication between the first actuator and both the supply conduit and the reservoir in response to the first function command. The second control valve to selectively provide regeneration fluid flow from the first rod chamber to the first head chamber when a first function command is less than a first function command limit, a second function command is greater than a second function command limit, and a second function load is greater than a second function load limit.

In another aspect, the present invention provides a hydraulic system including a pump to furnish fluid from a reservoir to a supply conduit, a first actuator having a first head chamber and a first rod chamber, and a second actuator having a second head chamber and a second rod chamber. The hydraulic system further includes a first control valve to selectively provide fluid communication between the first actuator and both the supply conduit and the reservoir in response to a first function command, and a second control valve to selectively provide fluid communication between the first actuator and both the supply conduit and the reservoir in response to the first function command. The second control valve to selectively provide regeneration fluid flow from the first rod chamber to the first head chamber in response to the first function command is less than a first function command limit, a second function command is greater than a second function command limit, and a second function load is greater than a second function load limit.

In yet another aspect, the present invention provides a method for providing regeneration fluid flow in a hydraulic system. The hydraulic system includes a first function operated by a first actuator, a second function operated by a second actuator, and a pump to furnish fluid from a reservoir to a supply conduit. The first actuator includes a first head chamber and a first rod chamber, and the second actuator includes a second head chamber and a second rod chamber. The first function operable in response to a first function command and the second function operable in response to a second function command. The method includes determining if the first function command is less than a first function command limit, if the second function command is greater than a second function command limit, and if the second function load is greater than a second function load limit, and upon determining that the first function command is less than the first function command limit, the second function command is greater than the second function command limit, and the pressure in the second head chamber is greater than the second function load limit, providing regeneration fluid flow from the first rod chamber to the first head chamber.

In still another aspect, the present invention provides a method for providing regeneration fluid flow in a hydraulic system. The hydraulic system includes a first function operated by a first actuator, a second function operated by a second actuator, and a pump to furnish fluid from a reservoir to a supply conduit. The first actuator includes a first head chamber and a first rod chamber, and the second actuator includes a second head chamber and a second rod chamber. The first function operable in response to a first function command and the second function operable in response to a second function command. The method includes determining if the first function is commanded in a similar direction as a force of gravity, and upon that the first function is commanded in a direction similar to the force of gravity, opening a regeneration fluid path providing fluid communication from the first head chamber to the first rod chamber. The method further includes determining if the second function command is non-zero, and upon determining that the second function command is non-zero, inhibiting fluid communication between the pump and the first rod chamber. The method further includes determining if the first function command is greater than a first function command limit, and upon determining that the first function command is greater than the first function command limit, providing fluid communication between the pump and the first rod chamber.

The foregoing and other aspects and advantages of the invention will appear from the following description. In the description, reference is made to the accompanying drawings which form a part hereof, and in which there is shown by way of illustration a preferred embodiment of the invention. Such embodiment does not necessarily represent the full scope of the invention, however, and reference is made therefore to the claims and herein for interpreting the scope of the invention.

DESCRIPTION OF DRAWINGS

The invention will be better understood and features, aspects and advantages other than those set forth above will become apparent when consideration is given to the following detailed description thereof. Such detailed description makes reference to the following drawings.

DETAILED DESCRIPTION OF THE INVENTION

The use of the terms "downstream" and "upstream" herein are terms that indicate direction relative to the flow of a fluid. The term "downstream" corresponds to the direction of fluid flow, while the term "upstream" refers to the direction opposite or against the direction of fluid flow.

Figure 1:
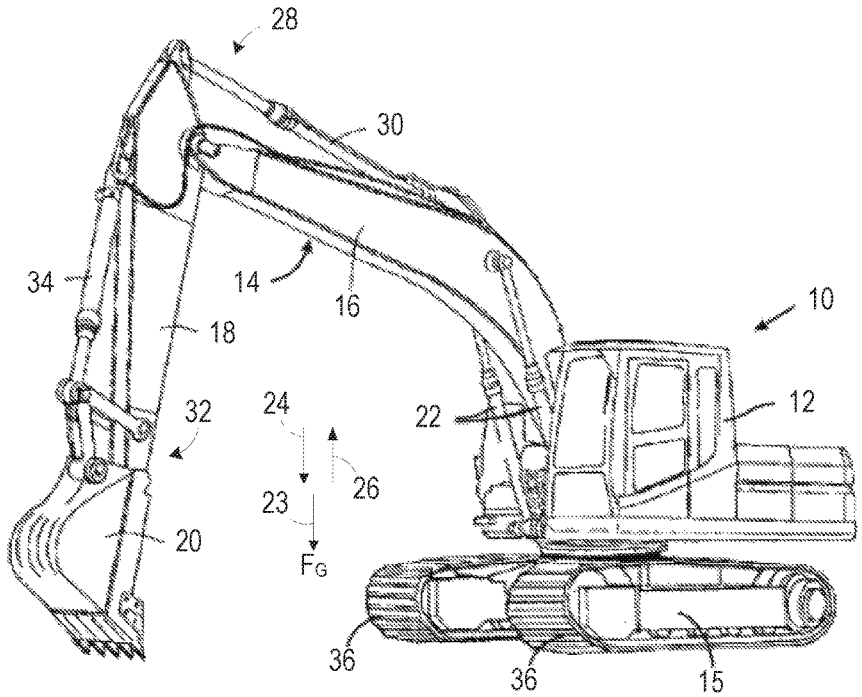
FIG. 1 shows a digging machine to which the present invention may be applied according to one embodiment of the present invention.

Referring initially to FIG. 1, a digging machine 10, in the form of an excavator, can include a cab 12 and a boom assembly 14. The cab 12 can swing clockwise and counterclockwise on a crawler 15 using a bidirectional hydraulic swing motor (not shown). The boom assembly 14 can be attached to the cab 12 and can include a boom 16, an arm 18, and a bucket 20 pivotally attached to each other. A pair of boom actuators 22 can be mechanically and hydraulically connected in parallel and can raise and lower the boom 16 with respect to the cab 12 in response to a boom function command. The boom actuators 22 can raise and lower the boom 16 in a direction 24 similar to the force of gravity 23 and a direction 26 generally opposite to the force of gravity 23. Typically, a cylinder of each of the boom actuators 22 can be attached to the cab 12 while a piston rod of each of the boom actuators 22 can be attached to the boom 16. Thus, the force of gravity 23 acting on the boom 16 tends to retract the piston rods into the cylinders. The arm 18 can be supported at a remote end 28 of the boom 16 and can pivot forward and backward using an arm actuator 30 in response to an arm function command. The bucket 20 can pivot at a tip 32 of the arm 18 when driven by a bucket actuator 34 in response to a bucket function command. In other embodiments, the bucket 20 may be replaced with other work implements, as is known in the art. The digging machine 10 can travel using a pair of left and right bidirectional travel motors (not shown) that can independently drive a pair of tracks 36 to propel the excavator over the ground. The commands to drive the various functions (i.e., the boom 16, the arm 18, the bucket 20, the tracks 36, etc.) of the digging machine 10 can be generated by an operator of the digging machine, for example, using one or more joy sticks.

Although the digging machine 10 was described above in the form of an excavator, it should be known that the invention described herein may be applied to alternative digging machines, for example, a backhoe or another machine utilizing a digging implement.

Figure 2:
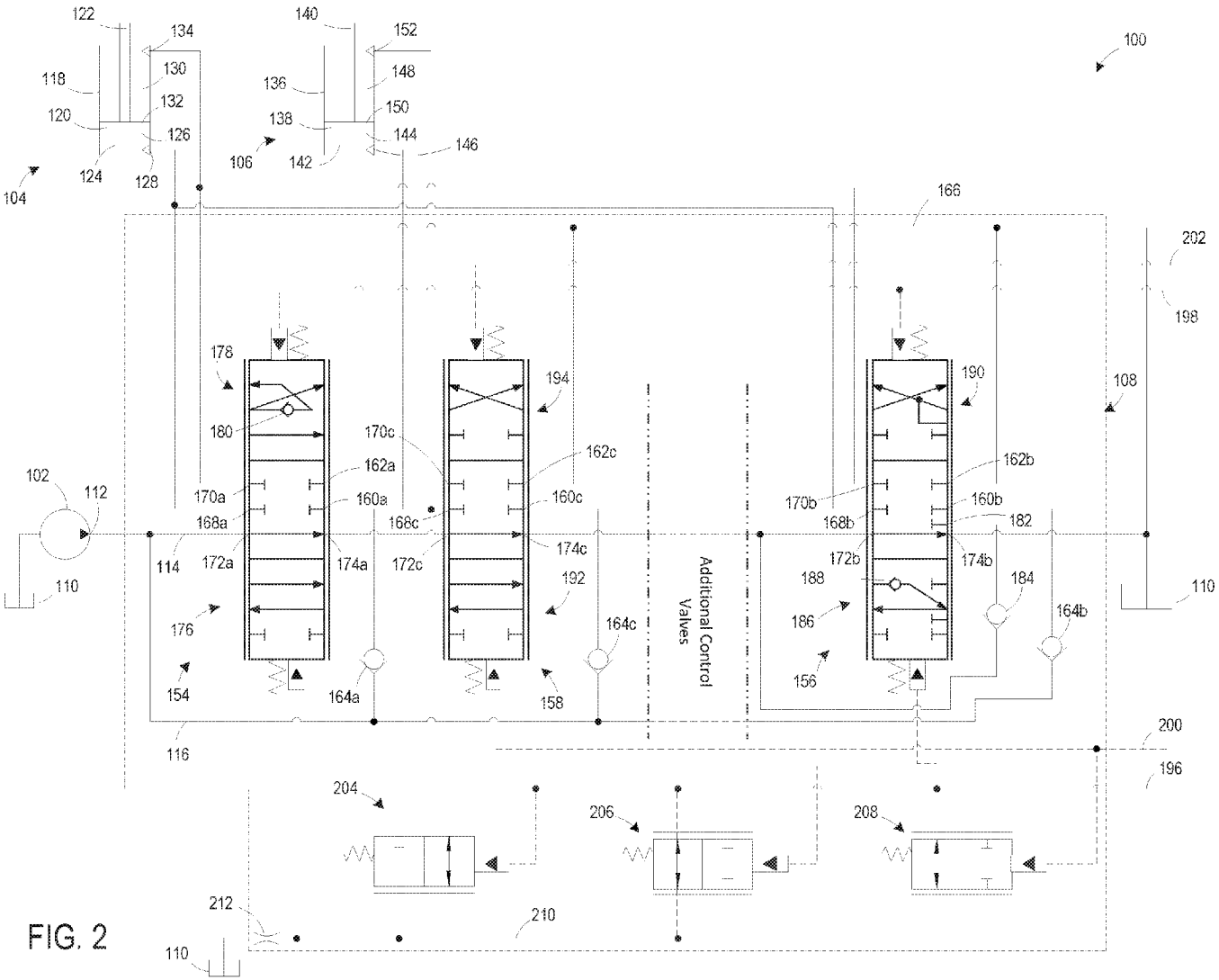
FIG. 2 shows a schematic illustration of a hydraulic system including a control valve assembly according to one embodiment of the present invention.

Turing to FIG. 2, a hydraulic system 100 that can be used on a digging machine, for example the digging machine 10 shown in FIG. 1, is shown according to one embodiment of the present invention. The hydraulic system 100 can include a pump 102, a first actuator 104, a second actuator 106, and a control valve assembly 108. The pump 102 can be a positive displacement pump which draws fluid, such as oil, from a reservoir 110 and furnishes that fluid under increased pressure at a pump outlet 112. The pump outlet 112 can be in fluid communication with a bypass passage 114 and a supply conduit 116. In other non-limiting examples, the pump 102 may be a variable displacement pump and the control valve assembly 102 may include one or more compensators, as is known in the art.

The first actuator 104 can include a first cylinder 118, a first piston 120 slidably arranged within the first cylinder 118, and a first rod 122 coupled to the first piston 120. The first actuator 104 can operate a first function in response to a first function command. In one non-limiting example, the first actuator 104 may operate (i.e., raise and lower) the boom 16 of the digging machine 10 in response to a boom command. The first cylinder 118 can define a first head chamber 124 defined by a head surface 126 of the first piston 120 and the first cylinder 118. The first head chamber 124 can be in fluid communication with a head port 128 of the first actuator 104. The first cylinder 118 can define a first rod chamber 130 defined by a rod surface 132 of the first piston 120, the first rod 122, and the first cylinder 118. The first rod chamber 130 can be in fluid communication with a rod port 134 of the first actuator 104. The head surface 126 of the first piston 120 can define an area greater than an area of the rod surface 132 of the first piston 120 because of the connection of the first rod 122 to the first piston 120 on the rod surface 132. For example, the head surface 126 can define an area that is greater than an area of the rod surface 132 by approximately an area defined by a diameter of the first rod 122.

The second actuator 106 can include a second cylinder 136, a second piston 138 slidably arranged within the second cylinder 136, and a second rod 140 coupled to the second piston 138. The second actuator 106 can operate a second function in response to a second function command. In one non-limiting example, the second actuator 104 may operate (i.e., extend and retract) the arm 18 of the digging machine 10. The second cylinder 136 can define a second head chamber 142 defined by a head surface 144 of the second piston 138 and the second cylinder 136. The second head chamber 142 can be in fluid communication with a head port 146 of the second actuator 106. The second cylinder 136 can define a second rod chamber 148 defined by a rod surface 150 of the second piston 138, the second rod 140, and the second cylinder 136. The second rod chamber 148 can be in fluid communication with a rod port 152 of the second actuator 106. The head surface 144 of the second piston 138 can define an area greater than an area of the rod surface 150 of the second piston 138 because of the connection of the second rod 140 to the second piston 138 on the rod surface 150. For example, the head surface 144 can define an area that is greater than an area of the rod surface 150 by approximately an area defined by a diameter of the second rod 140.

The control valve assembly 102 can include a first control valve 154, a second control valve 156, and a third control valve 158. In some embodiments, the first, second, and third control valves 154, 156, and 158 may be in the form of a spool. It should be known that the number of control valves is not meant to be limiting in any way and that the control valve assembly 102 may includes one or more additional control valves configured to control one or more mechanical mechanisms (e.g., an actuator or a motor) for one or more additional functions as required by a digging machine. Further, although the first, second, and third control valves 154, 156, and 158 are shown as three position valves, it should be known that control valves with more or less than three positions may be used.

The first control valve 154 can selectively provide fluid communication between the first actuator 104 and both the supply conduit 116 and the reservoir 110 in response to the first function command. The second control valve 156 can selectively provide fluid communication between the first actuator 104 and both the supply conduit 116 and the reservoir 110 in response to the first function command. The third control valve 158 can selectively provide fluid communication between the second actuator 106 and both the supply conduit 116 and the reservoir 110 in response to the second function command.

With continued reference to FIG. 2, the first, second, and third control valves 154, 156, and 158 can include similar features which are identified with like reference numerals and distinguished using the letters "a," "b," and "c" for the first, second, and third control valves 154, 156, and 158, respectively. The following description of the first control valve 154 also applies to the second and third control valves 156 and 158. The first control valve 154 can include an inlet port 160*a* and an outlet port 162*a*. The inlet port 160*a* can be in fluid communication with the supply conduit 116. A check valve 164*a* can be arranged upstream of the inlet port 160*a* to inhibit fluid to flow from the inlet port 160*a* back into the supply conduit 116 (e.g., when a large load acts on the associated actuator 104). The outlet port 162*a* can be in fluid communication with a return conduit 166. The return conduit 166 can provide fluid communication between the outlet port 162*a* and the reservoir 110.

The first control valve 154 can include a first workport 168*a*, a second workport 170*a*, a bypass inlet port 172*a* and a bypass outlet port 174*a*. The first control valve 154 can be biased into a neutral position, shown in FIG. 2, where fluid communication can be inhibited between the inlet port 160*a* and the first workport 168*a*, and between the second workport 170*a* and the outlet port 162*a*. When the first control valve 154 is in the neutral position, the bypass inlet port 172*a* can be in fluid communication with the bypass outlet port 174*a* thereby enabling the bypass passage 114 to extend through the first control valve 154. As the first control valve 154 is moved from the neutral position, the inlet port 160*a* and the outlet port 162*a* can open according to a valve displacement vs. flow area relationship which can be customized to meet specific operational requirements of a digging machine. Also, as the first control valve 154 is moved from the neutral position, the bypass inlet port 172*a* can begin to close (i.e., provide a greater restriction to fluid flow). The amount that the bypass inlet port 172*a* closes can be governed by a valve displacement vs. bypass flow area relationship which can be customized to meet specific operational requirement of the mobile machine. The bypass inlet ports 172*a*, 172*b*, and 172*c* and the bypass outlet ports 174*a*, 174*b*, and 174*c* of the first, second, and third control valves 154, 156, and 158 can be connected in series via the bypass passage 114. Downstream of the bypass outlet port 174*b*, the bypass passage 62 can be in fluid communication with the reservoir 16.

As described above, the first control valve 154 can selectively provide fluid communication between the first actuator 104 and both the supply conduit 116 and the reservoir 110 in response to the first function command. The first workport 168*a* can be in fluid communication with the first head chamber 124 of the first actuator 104. The second workport 170*a* can be in fluid communication with the first rod chamber 130 of the first actuator 104. The first control valve 154 can include a first position 176 where fluid communication is provided from the inlet port 160*a* to the first workport 168*a* and fluid communication is provided from the second workport 170*a* to the outlet port 162*a*. When the first control valve 154 is moved towards the first position 176, fluid can be provided from the supply conduit 116 (i.e., the pump 102) to the first rod chamber 124 and simultaneously fluid can be allowed to flow from the first rod chamber 130 to the reservoir 110. In this way, when the first control valve 154 is moved towards the first position 176, the first rod 122 can extend further from the first cylinder 118 in response to a force on the head surface 126 of the first piston 120 being greater than a force on the rod surface 132 of the first piston 120 plus any force acting on the rod 122 tending to retract the rod 122 into the cylinder 118. In one non-limiting example, when the first control valve 154 is moved towards the first position 176, the first actuator 104 can move the boom 16 of the digging machine 10 in a direction 26 generally opposite to the force of gravity 23.

The first control valve 154 can include a second position 178 where fluid communication is provided from the first workport 168*a* to the second workport 170*a* through a check valve 180, fluid communication is provided from the first workport 168*a* to the outlet port 162*a*, and fluid communication can be provided from the bypass inlet port 172*a* to the bypass outlet port 174*a*. The inlet port 160*a* can be closed when the first check valve 154 is in the second position 178. The check valve 180 can inhibit fluid flow from the second workport 170*a* to the first workport 168*a*. When the first control valve 154 is moved towards the second position 176, regeneration fluid flow can be provided from the first head chamber 124 to the first rod chamber 130 of the first actuator 104, and fluid can be provided from the first head chamber 124 to the reservoir 110. In one non-limiting example, when the first control valve 154 is moved towards the second position 178, the regeneration fluid flow from the first head chamber 124 to the first rod chamber 130 can enable the boom 16 of the digging machine 10 to be moved in the direction 24 similar to the force of gravity 23 by the force of gravity 23. That is, in this non-limiting example, the force of gravity 23 may be sufficient to overcome a greater force on the head surface 124 of the first piston 120, due to the larger area of the head surface 126 when compared to the area of the rod surface 132, to move the boom 16 in the direction 24 similar to the force of gravity 23.

As described above, the second control valve 156 can selectively provide fluid communication between the first actuator 104 and both the supply conduit 116 and the reservoir 110 in response to the first function command. The first workport 168*b* can be in fluid communication with the first head chamber 124 of the first actuator 104. The second workport 170*b* can be in fluid communication with the first rod chamber 130 of the first actuator 104. The second control valve 156 can include an auxiliary port 182 in fluid communication with the bypass passage 114 upstream of the second control valve 156 through a check valve 184. The check valve 184 can inhibit fluid to flow from the auxiliary port 182 back into the bypass passage 114. The inlet port 160*b* can define a different relationship of a flow area of the inlet port 160*b* to the first function command in the direction 26 similar to the force of gravity 23 than the auxiliary port 182. As shown in the graph 300 of FIG. 3, the flow area of the inlet port 160*c* may not begin to increase until higher first function commands in the direction 24 similar to the force of gravity 23 when compared to the flow area of the auxiliary port 182. This can enable first function to have a lowest priority (i.e., the first actuator 104 can be the last to receive, or not receive, flow from the pump 102) when the first function is commanded in the direction 24 similar to the force of gravity 23 and when the second function and/or any additional functions are commanded simultaneously, as will be described below.

With reference back to FIG. 2, the second control valve 156 can include a first position 186 where fluid communication can be provided from the second workport 170*b* to the inlet port 160*b* and fluid communication can be provided from the inlet port 160*b* to the first workport 168*b*. A check valve 188 can inhibit fluid to flow from the inlet port 160*b* to the second workport 170*b*. The bypass inlet port 174*b*, the outlet port 162*b*, the auxiliary port 182, and the bypass outlet port 174*b* can be closed when the second control valve is in the first position 186. When the second control valve 156 is moved towards the first position 186, regeneration fluid flow can be provided from the first rod chamber 130 to the first head chamber 124 of the first actuator 104, and fluid can be provided from supply conduit 116 to the first head chamber 124. In one non-limiting example, when the second control valve 156 is moved towards the first position 186, the regeneration fluid flow from the first rod chamber 130 to the first head chamber 124 and the flow from the supply conduit 116 to the first head chamber 124 can enable the boom 16 of the digging machine 10 to be moved in the direction 26 generally opposite to the force of gravity 23. In this non-limiting example, the regeneration fluid flow from the first rod chamber 130 to the first head chamber 124 provided by the second control valve 156 can move the first actuator 104 the direction 26 generally opposite to the force of gravity 23 using a lower flow of fluid from the supply conduit 116 (i.e., the pump 102 is required to output flow at a lower displacement) when compared to the first position 176 of the first control valve 154.

The second control valve includes a second position 190 where fluid communication can be provided between the first workport 168*b* and the outlet port 162*b*, fluid communication can be provided between both the auxiliary port 182 and the inlet port 162*b* and the second workport 170*b*, and the bypass outlet port 174*b* can be closed. When the second control valve 154 is moved towards the second position 190, fluid can be provided from the bypass passage 114 upstream of the second control valve 156 to the first rod chamber 130, fluid communication can be provided from the supply conduit 116 to the first rod chamber 130, and fluid communication can be provided from the first head chamber 124 to the reservoir 110. In this way, when the second control valve 156 is moved towards the second position 190, the first rod 122 can retract into the first cylinder 118 in response to a force on the rod surface 130 of the first piston 120 being greater than a force on the head surface 126 of the first piston 120 plus any force on the rod 122 tending to extend the rod 122 out of the cylinder 118. In one non-limiting example, when the second control valve 156 is moved towards the second position 190, the first actuator 104 can move the boom 16 of the digging machine 10 in the direction 26 generally similar to the force of gravity 23.

Figure 3:
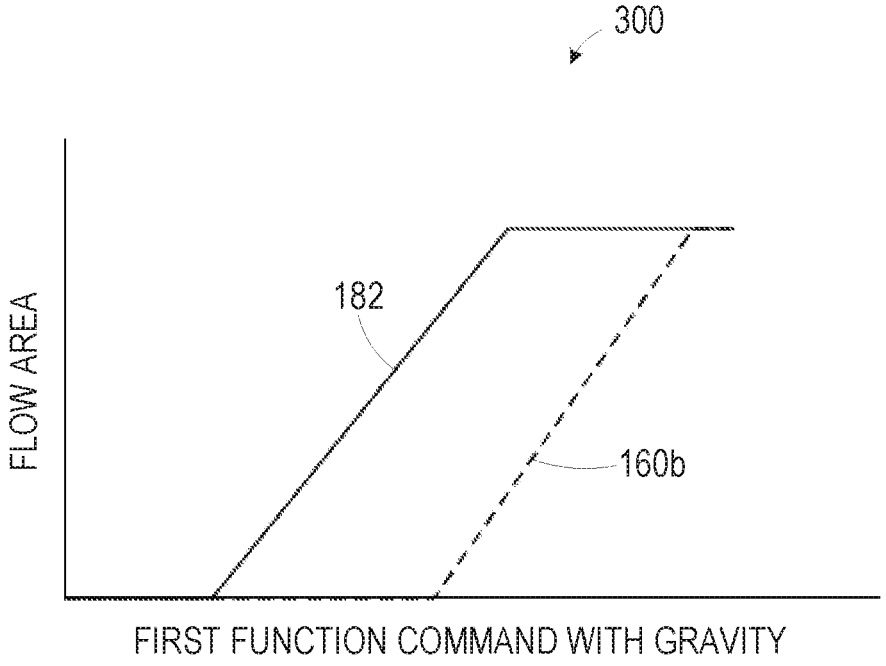
FIG. 3 shows a graph illustrating a relationship between a flow area of a primary bypass port and a secondary bypass port as a function of a first function command in a direction similar to a force of gravity according to one embodiment of the present invention.

As described above, the inlet port 160*b* and the auxiliary port 182 can define different flow area relationships (FIG. 3). This can enable the flow from the bypass passage 114 through the auxiliary port 182 to be a primary source of fluid flow to the first rod chamber 130, when the second control valve 156 moves toward the second position 190, as the inlet port 160*b* does not open until higher first function commands in the direction 26 similar to the force of gravity 23 (FIG. 3). Since the bypass passage 116 can be generally closed as other functions (i.e., the second function and/or any additional functions) by displacing a corresponding control valve from the neutral position, providing fluid flow primarily through the auxiliary port 182 to the first rod chamber 130 can provide the first function the lowest priority (i.e., the first actuator 104 can be the last to receive, or not receive, flow from the pump 102) when the first function is commanded in the direction 24 similar to the force of gravity 23 and when the second function and/or any additional functions are commanded simultaneously.

As described above, the third control valve 158 can selectively provide fluid communication between the second actuator 104 and both the supply conduit 116 and the reservoir 110 in response to the second function command. The first workport 168*c* can be in fluid communication with the second head chamber 142, and the second workport 170*c* can be in fluid communication with the second rod chamber 148. The third control valve 158 can include a first position 192 where fluid communication is provided between the inlet port 160*c* and the first workport 168*c*, and fluid communication is provided between the second workport 170*c* and the outlet port 162*c*. When the third control valve 158 is moved towards the first position 192, fluid can be provided from the supply conduit 116 to the second head chamber 142 and fluid can flow from the second rod chamber 148 to the reservoir 110. In this way, when the third control valve 158 is moved towards the first position 192, the second rod 140 of the second actuator 106 can extend further from the second cylinder 136. In one non-limiting example, when the third control valve 158 is moved towards the first position 192, the second rod 140 can move the arm 18 of the digging machine 10 in a first pivoting direction corresponding with the arm actuator 30 extending or moving out of the cylinder.

The third control valve includes a second position 194 where fluid communication can be provided between the inlet port 160*c* and the second workport 170*c*, and fluid communication can be provided between the first workport 168*c* and the outlet port 162*c*. When the third control valve 194 is moved toward the second position 194, fluid can be provided from the supply conduit 114 to the second rod chamber 148, and fluid can flow from the second head chamber 142 to the reservoir 110. In this way, when the third control valve 158 is moved towards the second position 194, the second rod 140 of the second actuator 106 can retract into the second cylinder 136. In one non-limiting example, when the third control valve 158 is moved towards the second position 194, the second rod 140 can move the arm 18 of the digging machine 10 in a second pivoting direction corresponding with the arm actuator 30 retracting or moving into the cylinder.

As described above, the first function can be commanded in the direction 24 similar to the force of gravity 23 or in the direction 26 generally opposite to the force of gravity 23. As is known in the art, function commands are typically mutually exclusive (i.e., a function typically cannot be commanded to two directions simultaneously). In the illustrated hydraulic system 100 of FIG. 2, the first function command can be communicated to the first and second control valves 154 and 156 by a first pilot signal line 196 and a second pilot signal line 198. In one non-limiting example, the first pilot signal line 196 of the first function command can provide a pressure signal proportional to the first function command in the direction 26 generally opposite to the force of gravity 23, and the second pilot signal line 198 of the first function command can provide a pressure signal proportional to the first function command in the direction 24 generally similar to the force of gravity 23. The second function command can be communicated to the third control valve 158 by a first pilot signal line 200 and a second pilot signal line 202. In one non-limiting example, the first pilot signal line 200 of the second function command can provide a pressure signal proportional to the second function command in an extend direction (i.e., extend the second rod 140 further from the second cylinder 136), and the second pilot signal line 202 of the second function command can provide a pressure signal proportional to the second function command in a retract direction (i.e., retract the second rod 140 into the second cylinder 136).

The illustrated hydraulic system 100 of FIG. 2 can include a first override valve 204, a second override valve 206, and a third override valve 208 each being pilot controlled. Although the illustrated first, second, and third, override valves 204, 206, and 208 are shown within the control valve assembly 102, it should be known that, in other embodiments, the first override valve 204, the second override valve 206, and/or the third override valve 208 may be arranged outside, or separate from, of the control valve assembly 102.

The first override valve 204 can selectively provide fluid communication from the first pilot signal line 196 of the first function command and an auxiliary first pilot signal line 210. The auxiliary first pilot line 210 can be in fluid communication with the reservoir 110 through an orifice 212. The first override valve 204 can be biased into a normally closed position where fluid is inhibited from flowing from the first pilot signal line 196 to the auxiliary first pilot signal line 210. The first override valve 204 can be moved between the normally closed position and an open position where fluid communication is provided from the first pilot signal line 196 to the auxiliary first pilot signal line 210 in response to a pressure the pressure in the first pilot signal line 196. The first override valve 204 can move into the open position when the pressure in the first pilot signal line 196 is greater than a first function command limit of the first function.

The second override valve 206 can selectively provide fluid communication from the first pilot signal line 196 to the auxiliary first pilot signal line 210. The second override valve 206 can be biased into a normally open position where fluid can flow from the first pilot signal line 196 to the auxiliary first pilot signal line 210. The second override valve 206 can be moved towards a closed position where fluid can be inhibited from flowing from the first pilot signal line 196 to the auxiliary pilot signal line 210 in response to a pressure in the second head chamber 142 of the second actuator 106. The second override valve 206 can move into the closed position when the pressure in the second head chamber 142 is greater than a second function load limit.

The third override valve 208 can selectively provide fluid communication from the first pilot signal line 196 to the auxiliary pilot signal line 210. The third override valve 208 can be biased into a normally open position where fluid can flow from the first pilot signal line 196 to the auxiliary first pilot signal line 210. The third override valve 208 can be moved towards a closed position where fluid can be inhibited from flowing from the first pilot signal line 196 to the auxiliary pilot signal line 210 in response to a pressure in the first pilot signal line 200 of the second function command. The third override valve 208 can move into the closed position when the pressure in the first pilot signal line 200 of the second function command is greater than a second function command limit.

The first control valve 154 can be biased towards the first position 176 by a pressure in the auxiliary first pressure pilot signal line 210, and can be biased towards the second position 178 by a pressure in the second pilot signal line 198 of the first function. The second control valve 158 can be biased towards the first position 186 by a pressure in the first pilot signal line 196 of the first function, and can be biased towards the second position 190 by a pressure in the second pilot signal line 198 of the first function. The third control valve 158 can be biased towards the first position 192 by a pressure in the first pilot signal line 200 of the second function, and can be biased towards the second position 194 by a pressure in the second pilot signal line 202 of the second function.

Figure 4:
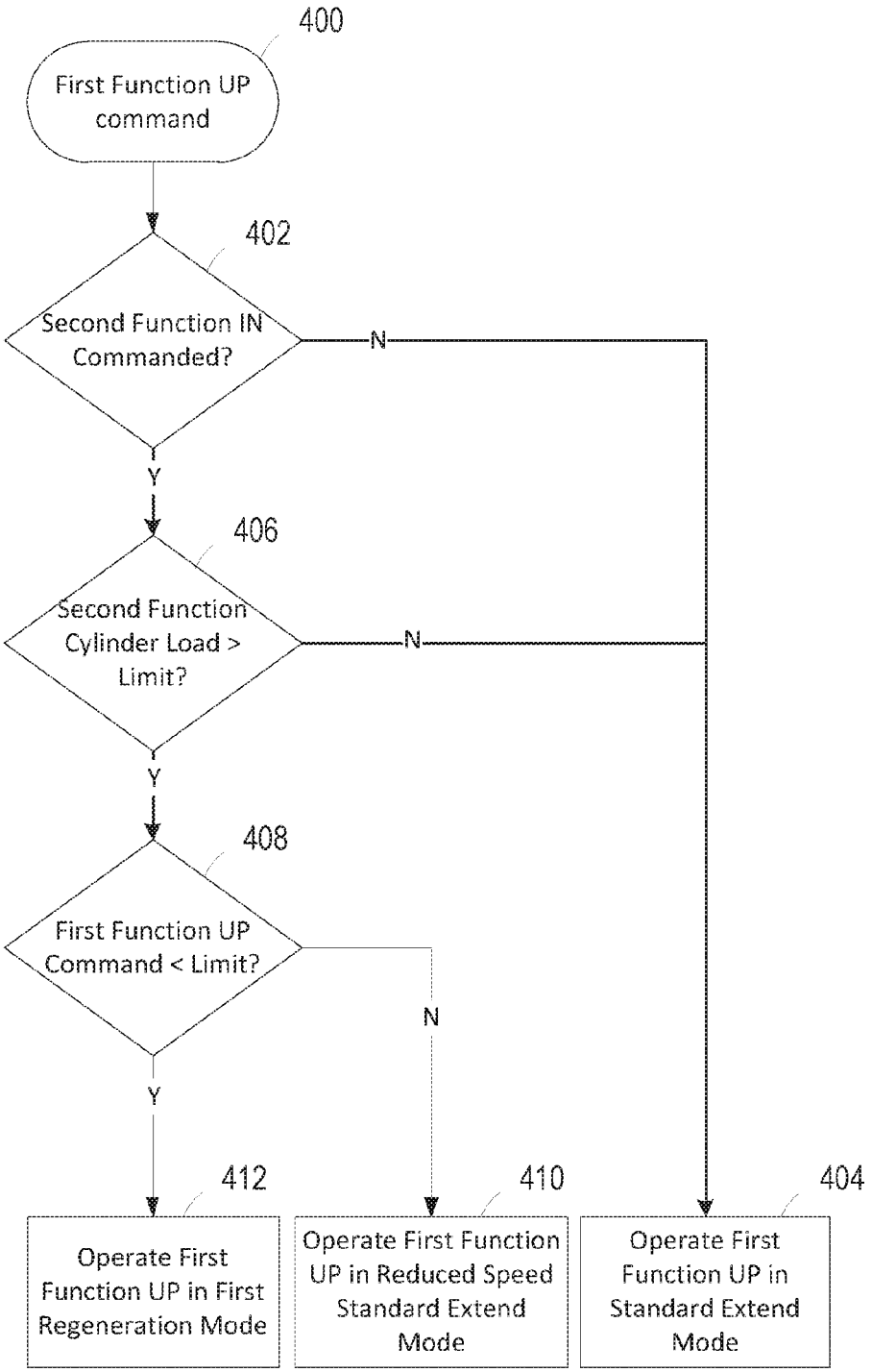
FIG. 4 shows a flow chart illustrating the steps for providing regeneration fluid flow when a first function is commanded in a direction generally opposite to the force of gravity according to one embodiment of the present invention.

One non-limiting example of the operation of the hydraulic system 100 when the first function operated by the first actuator 104 is commanded to move in the direction 26 generally opposite to the force of gravity 23 will be described with reference to FIGS. 2-4. As shown in FIG. 4, if the first function is commanded (e.g., using a joystick) to move in the direction 26 generally opposite to the force of gravity 23 by an operator utilizing the hydraulic system 100 at step 400, it can be determined at step 402 if the pressure in the second function command in a first pivoting direction is greater than the second function command limit. In the non-limiting example of FIG. 2, the second function command in a first pivoting direction is communicated to the hydraulic system 100 by the first pilot signal line 200 of the second function command. If the pressure in the first pilot signal line 200 of the second function command is not greater than the second function command limit, then the first function can be moved the direction 26 generally opposite to the force of gravity 23 in a standard extend mode at step 404.

In the standard extend mode, since the pressure in the first pilot signal line 200 of the second function command is not greater than the second function command limit, the third override valve 208 can be biased towards the normally open position and the pressure in the first pilot signal line 196 of the first function command can be communicated to the auxiliary first pilot signal line 210. As described above, the pressure in the first pilot signal line 196 of the first function can be proportional to the first function command in the direction 26 generally opposite to the force of gravity 23. This pressure in the first pilot signal line 196 of the first function command can then be communicated through the third override valve 208 and to the first control valve 154 to bias the first control valve 154 towards the first position 176. Simultaneously, the pressure in the first pilot signal line 196 of the first function can bias the second control valve 156 towards the first position 186. When the first control valve 154 is biased towards the first position 176, fluid can be provided from the supply conduit 116 to the first head chamber 124 and fluid can flow from the first rod chamber 130 to the reservoir 110. This can create a higher pressure in the first head chamber 124 than in the first rod chamber 130 and inhibit the regeneration fluid flow from the first rod chamber 130 to the first head chamber 124 provided by the second control valve 156 in the first position 186. Thus, in the standard extend mode, the first actuator 104 can move the first function in the direction 26 generally opposite to the force of gravity 23 by providing fluid flow to the first head chamber 124 with fluid from the supply conduit 116 provided by the pump 102.

If it is determined at step 402 that the pressure in the first pilot signal line 200 of the second function command is greater than the second function command limit, then it can be determined at step 406 if the second function load is greater than the second function load limit. In the non-limiting example of FIG. 2, the second function load can be proportional to the pressure in the second head chamber 142. If the second function load is not greater than the second function command limit, then the first function can be moved the direction 26 generally opposite to the force of gravity 23 in the standard extend mode at step 404, as described above.

If the second function load is greater than the second function command limit, then it can be determined at step 408 if the first function command in the direction 26 generally opposite to the force of gravity 23 is less than the first function command limit. In the non-limiting example of FIG. 2, the first function command in the direction 26 generally opposite to the force of gravity 23 is communicated to the hydraulic system 100 by the first pilot signal line 196 of the first function command. If the first function command is greater than the first function command limit, then the first function can be moved the direction 26 generally opposite to the force of gravity 23 in a reduced speed standard extend mode at step 410.

The reduced speed standard extend mode can be similar to the standard extend mode except a pressure in the auxiliary first pilot signal line 210 may be less than the pressure in the first pilot signal line 196. The pressure in the auxiliary first pilot signal line 210 can still move the first control valve 154 towards the first position 176, but not as far towards the first position 176 as when the hydraulic system 100 is in the standard extend mode (due to the reduced pressure in the auxiliary pilot signal line 210). Thus, in the reduced speed standard extend mode, the first actuator 104 can move the first function in the direction 26 generally opposite to the force of gravity 23 at a slower speed than the standard extend mode by providing fluid flow to the first head chamber 124 with fluid from the supply conduit 116 provided by the pump 102.

If the first function command is less than the first function command limit, then the first function can be moved the direction 26 generally opposite to the force of gravity 23 in a regeneration mode at step 412. In the regeneration mode, since the second function command is greater than the second function command limit, the second function load is greater than the second function load limit, and the first function command is less than the first function command limit, the third override valve 208 can be biased towards the closed position, the second override valve 206 can be biased towards the closed position, and the first override valve can be biased towards the closed position. Thus, each of the first, second, and third override valves 204, 206, and 208 can be biased closed. This can inhibit the pressure in the first pilot signal line 196 from being communicated to the auxiliary pilot signal line 210, and the pressure in the auxiliary pilot line 210 can be reduced to the reservoir 110 pressure. The pressure in the first pilot signal line 196 of the first function command can be communicated the second control valve 156 and bias the second control valve 156 towards the first position 186. Since the pressure in the auxiliary pilot signal line 210 is reduced to the reservoir 110 pressure, the pressure in the auxiliary pilot signal line 210 may not be sufficient to move the first control valve 154 towards the first position 176. Thus, in the regeneration mode, the first control valve 154 can be biased into the neutral position. With the first control valve 154 in the neutral position and the second control valve in the first position 186, the first control valve 14 can no longer provide fluid communication between the first rod chamber 130 and the reservoir 110 (as in the standard extend mode described above). The first rod chamber 130 and the first head chamber 124 can be in fluid communication and fluid can flow from the first rod chamber 130 into the first head chamber 124, and fluid communication can be provided from the supply conduit 116 to the first head chamber 124.

The regeneration fluid flow from the first rod chamber 130 to the first head chamber 124 can provide a higher pressure in the first head chamber 124 than in the standard extend mode. However, the fluid flow required from the pump 102 into the supply conduit 116 to displace the first actuator 104 is less than the standard extend mode. That is, the regeneration fluid flow from the first rod chamber 130 to the first head chamber 124 provided by the second control valve 156 can move the first actuator 104 the direction 26 generally opposite to the force of gravity 23 using a lower flow of fluid from the supply conduit 116 (i.e., the pump 102 is required to output flow at a lower displacement) when compared to the first position 176 of the first control valve 154. The hydraulic system 100 can remain in the regeneration mode until either the second function command is less than the second function command limit, the second function load is less than the second function load limit, or the first function command is greater than the first function command limit.

It should be known that the order of the determination steps 402, 406, and 408 of FIG. 4 are not meant to be limiting in any way, and they can be performed in any order as desired.

Figure 5:
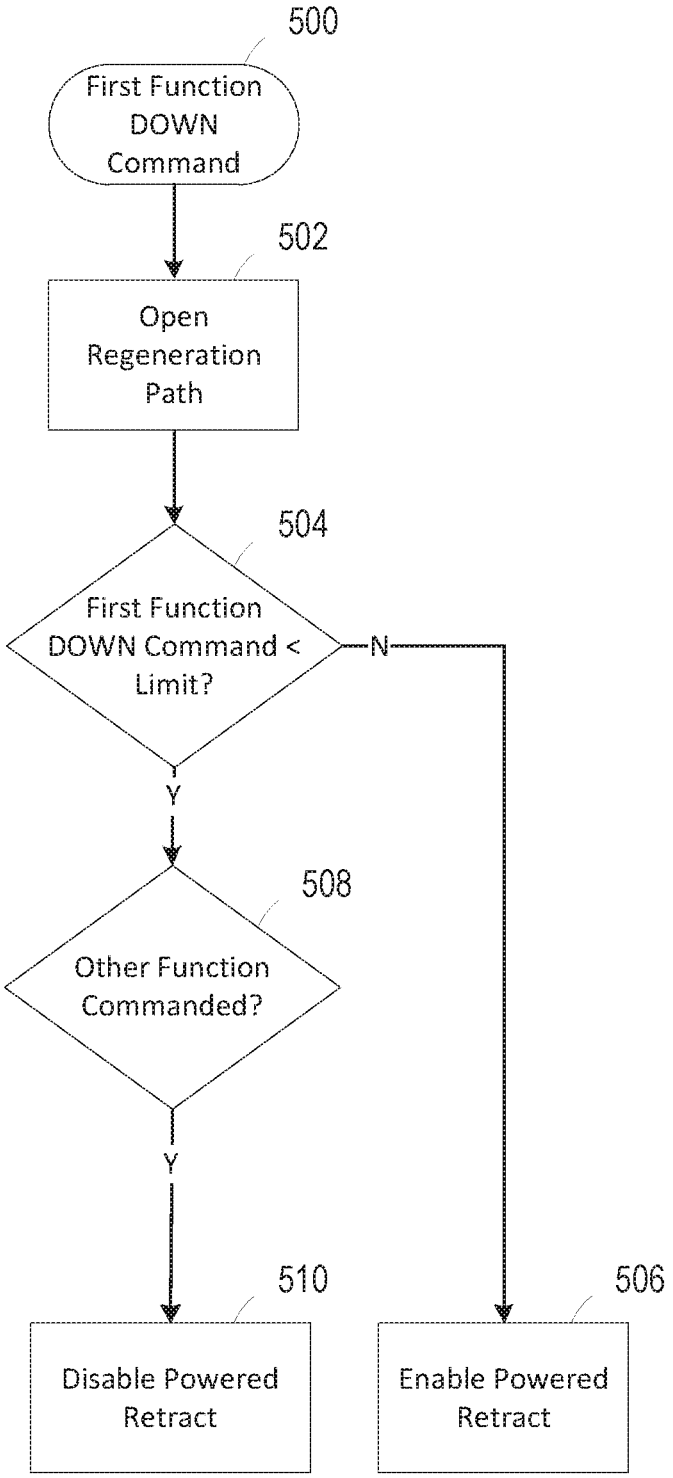
FIG. 5 shows a flow chart illustrating the steps for providing regeneration fluid flow when a first function is commanded in a direction similar to the force of gravity according to one embodiment of the present invention.

One non-limiting example of the operation of the hydraulic system 100 when the first function operated by the first actuator 104 is commanded to move in the direction 24 generally similar to the force of gravity 23 will be described with reference to FIGS. 2, 3, and 5. As shown in FIG. 5, if the first function is commanded (e.g., using a joystick) to move in the direction 24 generally similar to the force of gravity 23 by an operator utilizing the hydraulic system 100 at step 500, a regeneration fluid path providing fluid communication between the first head chamber 124 and the first rod chamber 130 can be opened at step 502. In the non-limiting example of FIG. 2, the pressure in the second pilot signal line 198 can bias the first control valve 154 towards the second position 178 where, as described above, fluid communication can be provided between the first head chamber 124 and the first rod chamber 130. Simultaneously, the pressure in the second pilot signal line 198 of the first function can bias the second control valve 156 towards the second position 190 by the pressure in the second pilot signal line 198. Next, it can be determined at step 504 if the first function command in the direction 24 generally similar to the force of gravity 23 is less than a secondary first function command limit. In the non-limiting example of FIG. 2, the first function command in the direction 24 generally similar to the force of gravity 23 can be communicated to the hydraulic system 100 by the second pilot signal line 198 of the first function command.

If the first function command in the direction 24 generally similar to the force of gravity 23 is greater than the secondary first function command limit, then the first function can be moved in the direction 24 generally similar to the force of gravity 23 with a powered retract enabled at step 506 (i.e., the pump 102 can provide fluid to the first rod chamber 130 to move the first function). Since the pressure in the second pilot signal line 198 of the first function command is greater than the secondary first function command limit, the inlet port 160*b* can provide fluid communication between the pump 102 and the first rod chamber 130. That is, the first function command the direction 24 generally similar to the force of gravity 23 can be high enough to open the inlet port 160*b* as shown in the flow area relationship of FIG. 3.

If the first function command in the direction 24 generally similar to the force of gravity 23 is less than the secondary first function command limit, then it is determined at step 508 if the second function command is non-zero. If the second function command is greater than zero (i.e., the second function is not commanded to move by the operator), then the first function can be moved in the direction 24 generally similar to the force of gravity 23 either by the force of gravity 23 acting on the first function and/or using fluid provided to the first rod chamber 130 by the pump 102.

If it is determined that the second function command, or any additional function command, is non-zero (i.e., at least one other function is commanded by the operator), then the first function can be moved in the direction 24 generally similar to the force of gravity 23 with a disabled power retract (i.e., the first function can be moved in the direction 24 generally similar to the force of gravity 23 without fluid supplied from the pump 102) at step 510. Since at least one other function is commanded and the first function command is less than the secondary function command limit, the flow to the first rod chamber 124 provided by the second control valve 156 in the second position 190 can be primarily provided via the auxiliary port 182 due to the flow area relationship illustrated in FIG. 3. That is, fluid communication between the pump 102 and the first rod chamber 130 can be inhibited. As shown in FIG. 2, when the second function is commanded (i.e., the second control valve 156 is displaced from the neutral position) fluid flow through the bypass passage 116 upstream of the second control valve 156 can be inhibited. Since the auxiliary port 182 is in fluid communication with the bypass passage 116 upstream of the second control valve 156, fluid flow to the first rod chamber 124 from the auxiliary port 182 can be inhibited. This can enable the regeneration fluid flow to be provided from the first head chamber 124 to the first rod chamber 130 of the first actuator 104 by the first control valve 154 in the second position 178. The regeneration fluid flow provided by the first control valve 154 in the second position 178 can enable the first rod 122 of the first actuator 104 to be moved in the direction 24 similar to the force of gravity 23 by the force of gravity 23. That is, in this non-limiting example, the force of gravity 23 may be sufficient to overcome a greater force on the head surface 124 of the first piston 120, due to the larger area of the head surface 126 when compared to the area of the rod surface 132, to move the boom 16 in the direction 24 similar to the force of gravity 23. This operation of the hydraulic system 100 when the first function is commanded in the direction 24 generally opposite to the force of gravity 23, described above, can provide the first function with a lowest priority (i.e., the first actuator 104 can be the last to receive, or not receive, flow from the pump 102) amongst the functions of the hydraulic system 100.

Figure 6:
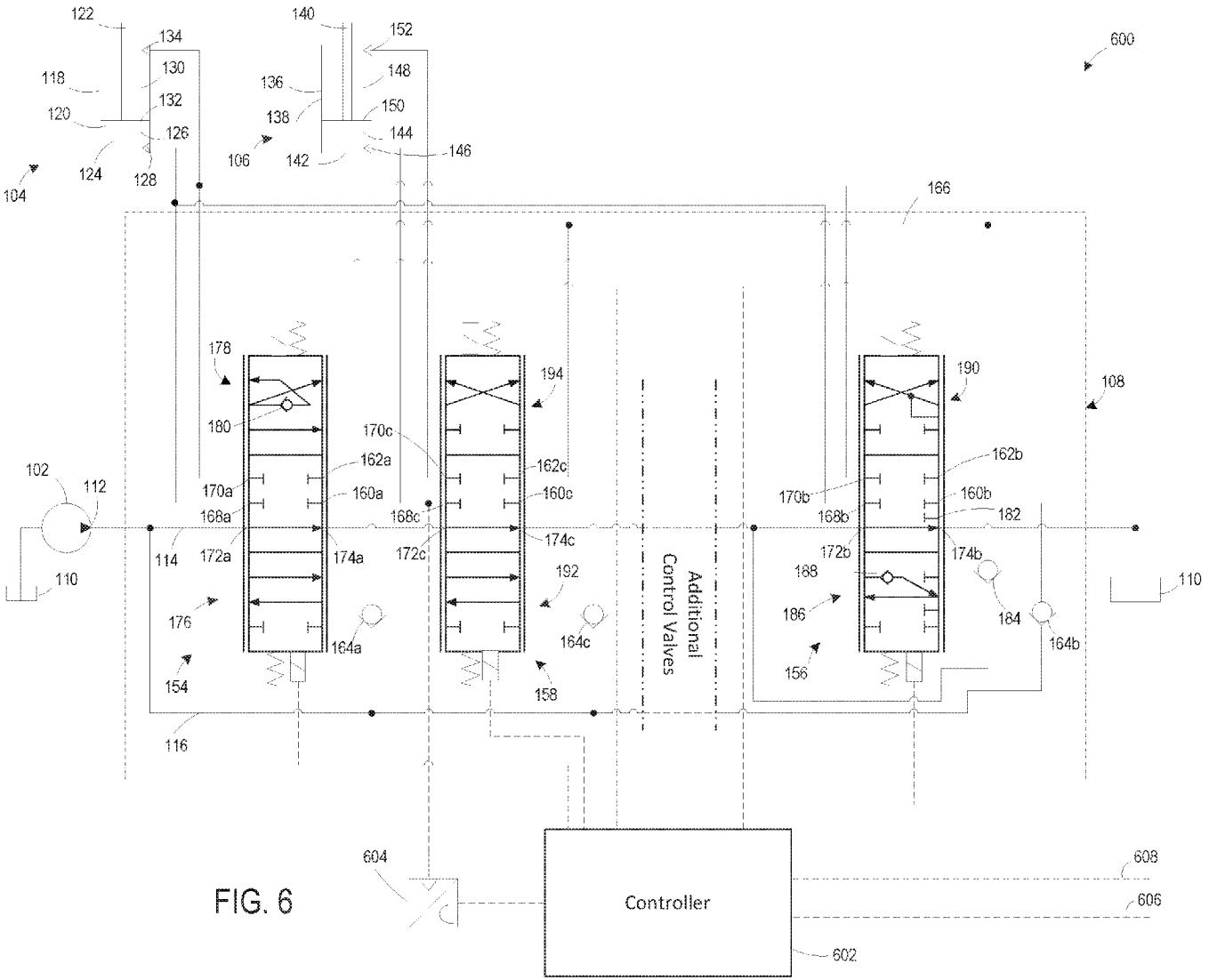
FIG. 6 shows a schematic illustration of an alternative configuration of the hydraulic system of FIG. 2 according to another embodiment of the present invention.

Turning to FIG. 6, a hydraulic system 600 that can be used on a digging machine, for example the digging machine 10 shown in FIG. 1, is shown according to another embodiment of the present invention. The hydraulic system 600 of FIG. 6 can be similar to the hydraulic system 100 of FIG. 2, with similar features identified using like reference numerals, except as described below or is apparent in FIG. 6.

In the hydraulic system 600, the first, second, and third control valves 154, 156, and 158 can be electronically actuated, for example using solenoids, in response to a signal from a controller 602. The controller 602 can receive inputs corresponding to the second function load, the first function command, and the second function command. As shown in FIG. 6, the controller 602 can be in communication, a pressure sensor 604, a first function command signal 606, and a second function command signal 608. The pressure sensor 604 can be configured to communicate a pressure in the second head chamber 142 to the controller 602. The first function command signal 606 can be configured to provide a signal to the controller 602 proportional to the direction and magnitude of the first function command. That is, the first function command signal 606 can provide similar functionality as the first pilot signal line 196 and the second pilot signal line 198 of the hydraulic system 100 of FIG. 2. The second function command signal 608 can be configured to provide a signal to the controller 602 proportional to the direction and magnitude of the second function command. That is, the second function command signal 608 can provide similar functionality as the first pilot signal line 200 and the second pilot signal line 202 of the hydraulic system 100 of FIG. 2.

In operation, the hydraulic system 600 can provide similar functionality as the hydraulic system 100, described above with reference to FIGS. 2-5, except that the control of the first, second, and third control valves 154, 156, and 158 can be controlled electronically in response to the inputs 604, 606, and 608 communicated to the controller. That is, the controller 602 can be configured to provide a signal to bias the first control valve 154 towards the neutral position and simultaneously provide a signal to bias the second control valve 156 towards the first position 186, thereby operating the hydraulic system 600 in the regeneration mode (described at step 412 in FIG. 4), when the first function command is less than the first function command limit, the second function command is greater than the second function command limit, and the second function load is greater than the second function load limit. The controller 602 can be configured to provide a signal to bias the first control valve 154 towards the second position 178 and the second control valve 156 towards the second position 190 when the first function command is less than the other first function command limit and another function of the hydraulic system 600 is commanded thereby operating the hydraulic system 600 in the second regeneration mode (described at step 508 in FIG. 5). Since the controller 602 can independently control the first, second, and third control valves 154, 156, and 158, the second control valve 156 may not be actuated in the second regeneration mode.

It should be known that the above-described hydraulic systems 100 and 600 may be applied to alternative hydraulic system designs. For example, the first actuator 104 and the second actuator 106, and thereby the first function and the second function, may be each be controlled using a valve assembly which operates in different metering modes as described in U.S. Pat. No. 6,880,332 issued to Plaff et al., the entire disclosure of which is incorporated herein by reference. It should be appreciated that the above described techniques and properties of the hydraulic systems 100 and 600 may be applied to a metering mode hydraulic system. In particular, the valve assemblies used to control the functions in a metering mode hydraulic system may be configured to provide regeneration fluid flow from a rod chamber to a head chamber of an actuator controlling a function in response to a first function command in a direction generally opposite to a force of gravity, a second function command, and a second function load. Additionally, the valve assemblies used to control the functions in a metering mode hydraulic system may be configured to provide a regeneration fluid flow path from a head chamber to a rod chamber of an actuator controlling a function when the function is commanded in a direction similar to a force of gravity. Further, the valve assemblies used to control the functions in a metering mode hydraulic system may be configured to inhibit fluid communication between a fluid source and the rod chamber of an actuator when multiple functions are commanded, and provide fluid communication between the fluid source and the rod chamber once the function command in a direction generally similar to the force of gravity exceeds a first function limit.

Within this specification embodiments have been described in a way which enables a clear and concise specification to be written, but it is intended and will be appreciated that embodiments may be variously combined or separated without parting from the invention. For example, it will be appreciated that all preferred features described herein are applicable to all aspects of the invention described herein.

Thus, while the invention has been described in connection with particular embodiments and examples, the invention is not necessarily so limited, and that numerous other embodiments, examples, uses, modifications and departures from the embodiments, examples and uses are intended to be encompassed by the claims attached hereto. The entire disclosure of each patent and publication cited herein is incorporated by reference, as if each such patent or publication were individually incorporated by reference herein.

Various features and advantages of the invention are set forth in the following claims.

We claim:

1. A control valve assembly for a hydraulic system, the hydraulic system including a first function operated by a first actuator, a second function operated by a second actuator, and a pump to furnish fluid from a reservoir to a supply conduit, the first actuator including a first head chamber and a first rod chamber and the second actuator including a second head chamber and a second rod chamber, the control valve assembly comprising:

a first control valve to selectively provide fluid communication between the first actuator and both the supply conduit and the reservoir in response to a first function command;

a second control valve to selectively provide fluid communication between the first actuator and both the supply conduit and the reservoir in response to the first function command;

the second control valve to selectively provide regeneration fluid flow from the first rod chamber to the first head chamber when a first function command is less than a first function command limit, a second function command is greater than a second function command limit, and a second function load is greater than a second function load limit.

2. The control valve assembly of claim 1, further comprising a third control valve to selectively provide fluid communication between the second actuator and both the supply conduit and the reservoir in response to the second function command.

3. The control valve assembly of claim 1, further comprising a first override valve to selectively provide fluid communication between a first pilot signal line of the first function command and an auxiliary first pilot signal line of the first function command in response to a pressure in the first pilot signal line of the first function command.

4. The control valve assembly of claim 1, further comprising a first override valve to inhibit fluid communication between a first pilot signal line of the first function command and an auxiliary first pilot signal line of the first function command when the pressure in a first pilot signal line of the second function is greater than the second function command limit, and the second function load is greater than a second function load limit.

5. The control valve assembly of claim 3, wherein when the first override valve inhibits fluid communication between the first pilot signal line of the first function command and the auxiliary first pilot signal line of the first function command, the first control valve moves towards a neutral position to restrict a flow path between the first rod chamber and the reservoir and enables the regeneration fluid flow from the first rod chamber to the first head chamber.

6. The control valve assembly of claim 3, further comprising a second override valve to selectively inhibit fluid communication between the first pilot signal line of the first function command and the auxiliary first pilot signal line of the first function command in response to the second function load limit.

7. The control valve assembly of claim 6, further comprising a third override valve to selectively inhibit fluid communication between the first pilot signal line of the first function command and the auxiliary first pilot signal line of the first function command in response to a pressure in a first pilot signal line of the second function.

8. The control valve assembly of claim 1, wherein the first control valve selectively provides regeneration flow from the first head chamber to the first rod chamber when the first function command is less than another first function command limit and the second function command is non-zero.

9. The control valve assembly of claim 8, wherein the first control valve selectively provides regeneration flow from the first head chamber to the first rod chamber when a pressure in a second pilot supply line of the first function command is less than the other first function command limit and the second function command is non-zero.

10. The control valve assembly of claim 8, wherein one of the first control valve and the second control valve includes an auxiliary port in fluid communication with a bypass passage upstream of the one of the first control valve and the second control valve, the auxiliary port defining a different relationship of flow area to the first function command than an inlet port of the one of the first control valve and the second control valve, the inlet port in fluid communication with the supply conduit.

11. The control valve assembly of claim 10, wherein when the second function command is non-zero fluid flow from the bypass passage to the auxiliary port is inhibited.

12. The control valve assembly of claim 1, further comprising a controller in communication with the first function command, the second function command, and the second function load, the controller configured to selectively move the first control valve in response to the first function command and move the second control valve in response to the second function command.

13. The control valve assembly of claim 12, wherein the controller instructs the second control valve to move to provide the regeneration fluid flow from the first rod chamber to the first head chamber when the first function command is less than the first function command limit, the second function command is greater than the second function command limit, and the pressure in the second head chamber is greater than the second function load limit.

14. The control valve assembly of claim 12, wherein the controller instructs the first control valve to move to provide regeneration flow from the first head chamber to the first rod chamber when the first function command is less than a second function command limit and the second function command is non-zero.

15. The control valve assembly of claim 1, wherein the second function load is measured by a pressure in the second head chamber.

16. A hydraulic system comprising:

a pump to furnish fluid from a reservoir to a supply conduit;

a first actuator including a first head chamber and a first rod chamber;

a second actuator including a second head chamber and a second rod chamber;

a first control valve to selectively provide fluid communication between the first actuator and both the supply conduit and the reservoir in response to a first function command; and a second control valve to selectively provide fluid communication between the first actuator and both the supply conduit and the reservoir in response to the first function command;

the second control valve to selectively provide regeneration fluid flow from the first rod chamber to the first head chamber in response to a first function command is less than a first function command limit, a second function command is greater than a second function command limit, and a second function load is greater than a second function load limit.

17. The hydraulic system of claim 16, further comprising a third control valve to selectively control a flow of fluid between the second actuator and both the supply conduit and the reservoir in response to the second function command.

18. The hydraulic system of claim 16, wherein the first control valve selectively provides regeneration flow from the first head chamber to the first rod chamber when the first function command is less than a second function command limit and the second function command is non-zero.

19. The hydraulic system of claim 16, wherein the first control valve selectively provides regeneration flow from the first head chamber to the first rod chamber when a pressure in a second pilot supply line of the first function command is less than a second function command limit and the second function command is non-zero.

20. The hydraulic system of claim 16, wherein further comprising a first override valve to selectively inhibit fluid communication between a first pilot signal line of the first function command and an auxiliary first pilot signal line of the first function command in response to a pressure in the first pilot signal line.

21. The hydraulic system of claim 20, wherein when the first override valve inhibits fluid communication between the first pilot signal line of the first function command and the auxiliary first pilot signal line of the first function command, the first control valve moves towards a neutral position to restrict a flow path between the first rod chamber and the reservoir and enable the regeneration fluid flow from the first rod chamber to the first head chamber.

22. The hydraulic system of claim 16, further comprising a controller in communication with the first function command, the second function command, and the pressure in the second head chamber, the controller configured to selectively move the first control valve in response to the first function command and move the second control valve in response to the second function command.

23. The hydraulic system of claim 22, wherein the controller instructs the second control valve to move to provide the regeneration fluid flow from the first rod chamber to the first head chamber when the first function command is less than the first function command limit, the second function command is greater than the second function command limit, and the pressure in the second head chamber is greater than the second function load limit.

24. The hydraulic system of claim 22, wherein the controller instructs the first control valve to move to provide regeneration flow from the first head chamber to the first rod chamber when the first function command is less than a second function command limit and the second function command is non-zero.

25. The hydraulic system of claim 16, wherein the second function load is measured by a pressure in the second head chamber.

26. A method for providing regeneration fluid flow in a hydraulic system, the hydraulic system including a first function operated by a first actuator, a second function operated by a second actuator, and a pump to furnish fluid from a reservoir to a supply conduit, the first actuator including a first head chamber and a first rod chamber and the second actuator including a second head chamber and a second rod chamber, the first function operable in response to a first function command and the second function operable in response to a second function command, the method comprising:

determining if the first function command is less than a first function command limit, if the second function command is greater than a second function command limit, and if the second function load is greater than a second function load limit; and upon determining that the first function command is less than the first function command limit, the second function command is greater than the second function command limit, and the second function load is greater than the second function load limit, providing regeneration fluid flow from the first rod chamber to the first head chamber;

actuating a first override valve to inhibit fluid communication between a first pilot signal line of the first function command and an auxiliary first pilot signal line of the first function command; and actuating a second override valve and a third override valve to inhibit fluid communication between the first pilot signal line of the first function and the auxiliary first pilot signal line of the first function command.

27. A method for providing regeneration fluid flow in a hydraulic system, the hydraulic system including a first function operated by a first actuator, a second function operated by a second actuator, and a pump to furnish fluid from a reservoir to a supply conduit, the first actuator including a first head chamber and a first rod chamber and the second actuator including a second head chamber and a second rod chamber, the first function operable in response to a first function command and the second function operable in response to a second function command, the method comprising:

determining if the first function is commanded in a similar direction as a force of gravity;

upon that the first function is commanded in a direction similar to the force of gravity, opening a regeneration fluid path providing fluid communication from the first head chamber to the first rod chamber;

determining if the second function command is non-zero;

upon determining that the second function command is non-zero, inhibiting fluid communication between the pump and the first rod chamber;

determining if the first function command is greater than a first function command limit; and upon determining that the first function command is greater than the first function command limit, providing fluid communication between the pump and the first rod chamber; and providing a lowest priority to the first function.

* * * * *